US007967288B2

(12) United States Patent
Nishinakama

(10) Patent No.: US 7,967,288 B2
(45) Date of Patent: Jun. 28, 2011

(54) PAPER SUPPLY APPARATUS, IMAGE FORMING APPARATUS, AND IMAGE READING APPARATUS WITH ABUTMENT MEMBER PROVIDED ON MOVABLE GUIDE

(75) Inventor: Hideki Nishinakama, Higashiosaka (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/853,983

(22) Filed: Aug. 10, 2010

(65) Prior Publication Data

US 2011/0037220 A1 Feb. 17, 2011

(30) Foreign Application Priority Data

Aug. 11, 2009 (JP) ..... 2009-186814

(51) Int. Cl.
*B65H 1/00* (2006.01)

(52) U.S. Cl. ..... 271/171; 271/125; 271/169; 271/241

(58) Field of Classification Search ..... 271/125, 271/169, 171, 241
See application file for complete search history.

(56) References Cited

U.S. PATENT DOCUMENTS

2005/0110206 A1* 5/2005 Hsieh ..... 271/117
2008/0315499 A1* 12/2008 Murrell ..... 271/109

FOREIGN PATENT DOCUMENTS

| | | | |
|---|---|---|---|
| JP | 05-342404 | | 12/1993 |
| JP | 08-301473 | | 11/1996 |
| JP | 08301473 | A * | 11/1996 |
| JP | 2001-080761 | | 3/2001 |
| JP | 2001080761 | A * | 3/2001 |
| JP | 2001-328752 | | 11/2001 |
| JP | 2007-070069 | | 3/2007 |

* cited by examiner

*Primary Examiner* — Gerald W McClain
(74) *Attorney, Agent, or Firm* — Workman Nydegger

(57) ABSTRACT

A paper supply apparatus includes: a placement surface on which paper to be transported is placed; a fixed guide that guides the transport of the paper; a movable guide whose distance to the fixed guide in the widthwise direction of the paper is capable of being adjusted and that guides the transport of the paper; a paper supply roller that abuts the paper in a position, on the side where the fixed guide is located, and that is rotationally driven so as to transport the paper; an abutment member, provided on the movable guide. The abutment member is disposed in a position so that a second abutment point where the abutment member abuts the surface of the paper is further downstream in the transport direction of the paper than a first abutment point where the paper supply roller abuts the surface of the paper.

24 Claims, 17 Drawing Sheets

PAPER SUPPLY APPARATUS, IMAGE FORMING APPARATUS, AND IMAGE READING APPARATUS WITH ABUTMENT MEMBER PROVIDED ON MOVABLE GUIDE

BACKGROUND

1. Technical Field

The present invention relates to a paper supply apparatus used for automatically transporting paper, and an image forming apparatus and an image reading apparatus provided with such a paper supply apparatus.

2. Related Art

Generally speaking, image forming apparatuses such as printers and image reading apparatuses such as scanners are provided with paper supply apparatuses that supply paper from a placement surface of a paper supply tray to an image forming unit or an image reading unit, and such paper supply apparatuses include paper supply rollers that are rotationally driven while making contact with the paper in order to automatically supply the paper placed on the placement surface.

Furthermore, generally speaking, paper supply apparatuses provided with edge guides that guide the transport of the paper by making contact with the side ends of the paper in the widthwise direction, where the edge guides are configured of a fixed guide and a movable guide so as to enable the guidance of a variety of sizes of paper to be transported, are known.

Meanwhile, a paper supply apparatus in which a paper supply roller is disposed so as to abut the surface of paper on the side of the fixed guide has been disclosed (for example, see JP-A-2001-80761).

JP-A-2001-80761 discusses a support shaft, to which a pickup unit has been attached, being supported by a side plate using a cantilever structure. To be more specific, with the paper supply apparatus disclosed in JP-A-2001-80761, the pickup unit is attached to a tip portion of the support shaft, which extends from a fixed guide (the side plate), and a paper supply roller is disposed on an end of the pickup unit so as to be capable of rotation. According to such a configuration, the surface of the paper is held down by the paper supply roller on the side where the fixed guide is located, and the paper is transported thus.

Incidentally, with paper supply apparatuses that include a paper supply roller that is rotationally driven while making contact with the surface of the paper on the side where the fixed guide is located, there are cases where the paper is transported in a state in which the paper is tilted relative to the transport direction. More specifically, as shown in FIGS. 19 and 20, a force that transports paper P is effected on one side of the paper P in a widthwise direction H by a paper supply roller 125 that is located on the side of a fixed guide 122 and that is rotationally driven while making contact with the surface of the paper P; however, there are cases where, when paper P that is highly elastic, such as heavy paper or the like, is transported, the side of the paper P on which the paper supply roller 125 is not located (that is, the side where a movable guide 103 is located) lifts away from a placement surface 121*a* while the paper P is being transported. The paper P lifting away in this manner causes a problem in that the paper P is transported by the paper supply apparatus 102 in a state in which the paper P is tilted relative to the transport direction.

One conceivable measure for avoiding such a problem is to provide an abutment member that abuts the surface of the paper, like the paper supply roller, on the side where the movable guide is located as well. It is also conceivable to bias the abutment member, which abutments the surface of the paper on the side where the movable guide is located, toward the placement surface using an elastic member, thereby effectively holding down the surface of the paper on the side where the movable guide is located using the abutment member.

However, when the abutment member is caused to abut the surface of the paper in the same manner in which the paper supply roller abuts the surface of the paper so as to suppress both sides of the paper from lifting off in the widthwise direction, there are cases where the abutment member, which is biased toward the placement surface, is damaged. In particular, it is necessary to bias the abutment member using an even stronger force when the paper is heavy paper or the like, and there are cases where the strength of the abutment member cannot be ensured.

SUMMARY

An advantage of some aspects of the invention is to provide a paper supply apparatus, an image forming apparatus, and an image reading apparatus capable of suppressing paper from being transported in a state where the paper is tilted relative to a transport direction, and capable of ensuring the strength of an abutment member that is biased toward a placement surface.

A paper supply apparatus according to an aspect of the invention includes: a placement surface on which paper to be transported is placed; a fixed guide that guides the transport of the paper by making contact with one side of the paper, in the widthwise direction; a movable guide whose distance to the fixed guide in the widthwise direction of the paper is capable of being adjusted and that guides the transport of the paper by making contact with the other side of the paper, in the widthwise direction; a paper supply roller that abuts a surface of the paper in a position, between the fixed guide and the movable guide, on the side where the fixed guide is located, and that is rotationally driven so as to transport the paper; an abutment member, provided on the movable guide, that abutments the surface of the paper; and an elastic member that biases the abutment member toward the placement surface. The abutment member is disposed in a position so that a second abutment point where the abutment member abuts the surface of the paper is further downstream in the transport direction of the paper than a first abutment point where the paper supply roller abuts the surface of the paper.

According to this aspect of the invention, the abutment member is provided in the movable guide and abuts the surface of the paper, and the elastic member is provided biasing the abutment member toward the placement surface; therefore, not only is the surface of the paper held down by the paper supply roller at a position on the side where the fixed guide is located, but the surface of the paper can also be held down by the abutment member at a position on the side where the movable guide is located. Accordingly, both sides of the paper in the widthwise direction can be suppressed from lifting off even when highly-elastic heavy paper is transported, which in turn makes it possible to suppress the paper from being transported in a state in which the paper is tilted relative to the direction of the transport (that is, the transport direction). Meanwhile, the abutment member is disposed in a position so that the second abutment point where the abutment member abuts the surface of the paper is further downstream in the transport direction of the paper than a first abutment point where the paper supply roller abuts the surface of the paper. As a result, the abutment member can be caused to abut the surface of the paper with a weaker force than the force with which the paper supply roller is caused to abut the surface of the paper. Accordingly, the strength of the abutment member can be ensured without damaging the abutment member that is biased toward the placement surface.

According to another aspect of the invention, the paper supply apparatus further includes a support member that supports the abutment member in a freely-rotatable state on the movable guide, and the abutment member is biased toward the placement surface along with the support member.

According to this aspect of the invention, the abutment member, which is supported by the support member in a freely-rotatable state, is biased toward the placement surface along with the support member. As a result, a structure that supports the support member in a freely-rotatable state (in other words, a shaft support portion that supports a rotation shaft provided in the support member) may be formed as a configuration of the movable guide for biasing the abutment member toward the placement surface. Accordingly, in order to ensure that the second abutment point where the abutment member abuts the surface of the paper is located further downstream in the transport direction of the paper than the first abutment point where the paper supply roller abuts the surface of the paper, the support member may be provided extending toward the downstream side in the transport direction. As a result, it is no longer necessary to provide the movable guide extending toward the downstream side in the transport direction farther than is needed, which makes it possible to reduce the size of the movable guide.

In the paper supply apparatus according to the aspect of the invention, further, the abutment member is a roller supported in a rotatable state by the support member. According to this aspect of the invention, the abutment member is a roller that is capable of rotation, and thus it is possible to suppress the occurrence of friction, which inhibits the transport of the paper, caused by the abutment member.

In the paper supply apparatus according to the aspect of the invention, the abutment member is disposed in a position that is at a predetermined interval from the placement surface. According to this aspect of the invention, the abutment member is disposed in a position that is at a predetermined interval from the placement surface on which the paper is placed. In other words, the abutment member abuts the surface of the paper if there is greater than or equal to a predetermined number of sheets of paper placed on the placement surface, whereas the abutment member does not abut the surface of the paper if there are less than a predetermined number of sheets of paper placed on the placement surface. Accordingly, the paper can be inserted between the placement surface and the abutment member more easily than in the case where the abutment member is provided making contact with the placement surface.

In the paper supply apparatus according to the aspect of the invention, the abutment member is disposed in a position where the abutment member abuts the surface of the uppermost sheet of paper in the case where the maximum number of sheets of paper that can be loaded has been placed upon the placement surface. According to this aspect of the invention, the abutment member is disposed in a position where the abutment member abuts the surface of the uppermost sheet of paper in the case where the maximum number of sheets of paper that can be loaded has been placed upon the placement surface, and thus the paper can be inserted between the placement surface and the abutment member with ease, with the exception of the case where the maximum number of sheets of paper has been loaded upon the placement surface.

In the paper supply apparatus according to the aspect of the invention, the movable guide is provided with a protruding portion that protrudes toward the fixed guide, and the number of sheets of paper that can be loaded upon the placement surface is regulated by the protruding portion.

According to this aspect of the invention, the number of sheets of paper that can be loaded upon the placement surface is regulated by the protruding portion provided in the movable guide, and thus the maximum number of sheets of paper that can be loaded upon the placement surface can be regulated by the protruding portion. Accordingly, by making an interval between the placement surface and the abutment member uniform with an interval between the placement surface and the protruding portion, the abutment member can be disposed in a position where the abutment member abuts the surface of the uppermost sheet of paper in the case where the maximum number of sheets of paper that can be loaded has been placed upon the placement surface.

In the paper supply apparatus according to the aspect of the invention, the protruding portion has a downstream side end portion provided on the downstream side of the protruding portion in the transport direction of the paper, and the protruding portion is formed so that an interval between the placement surface and the downstream side end portion increases progressively toward the downstream side in the transport direction.

According to this aspect of the invention, the protruding portion is formed so that the interval between the placement surface and the downstream side end portion of the protruding portion increases progressively toward the downstream side in the transport direction of the paper. Accordingly, the paper can be prevented from being damaged by the protruding portion when the paper is transported downstream in the transport direction and in the direction away from the placement surface.

In the paper supply apparatus according to the aspect of the invention, the elastic member is a torsion coil spring that is attached to the movable guide. According to this aspect of the invention, the elastic member is a torsion coil spring that is attached to the movable guide, and thus the abutment member can be biased toward the placement surface by using the torsion momentum of the torsion coil spring.

An image forming apparatus according to another aspect of the invention includes the aforementioned paper supply apparatus and an image forming unit that forms an image on the paper. According to this aspect of the invention, the image forming apparatus includes the aforementioned paper supply apparatus and the image forming unit that forms an image on the paper, and thus the same effects as described above can be achieved, and an image can be properly formed on the paper by suppressing the paper from being transported in a state in which the paper is tilted relative to the transport direction.

An image reading apparatus according to another aspect of the invention includes the aforementioned paper supply apparatus and an image reading unit that reads an image formed on the paper. According to this aspect of the invention, the image reading apparatus includes the aforementioned paper supply apparatus and the image reading unit that reads an image formed on the paper, and thus the same effects as described above can be achieved, and an image formed on the paper can be properly read by suppressing the paper from being transported in a state in which the paper is tilted relative to the transport direction.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a specific embodiment of the invention will be described based on the drawings.

Figure 1:
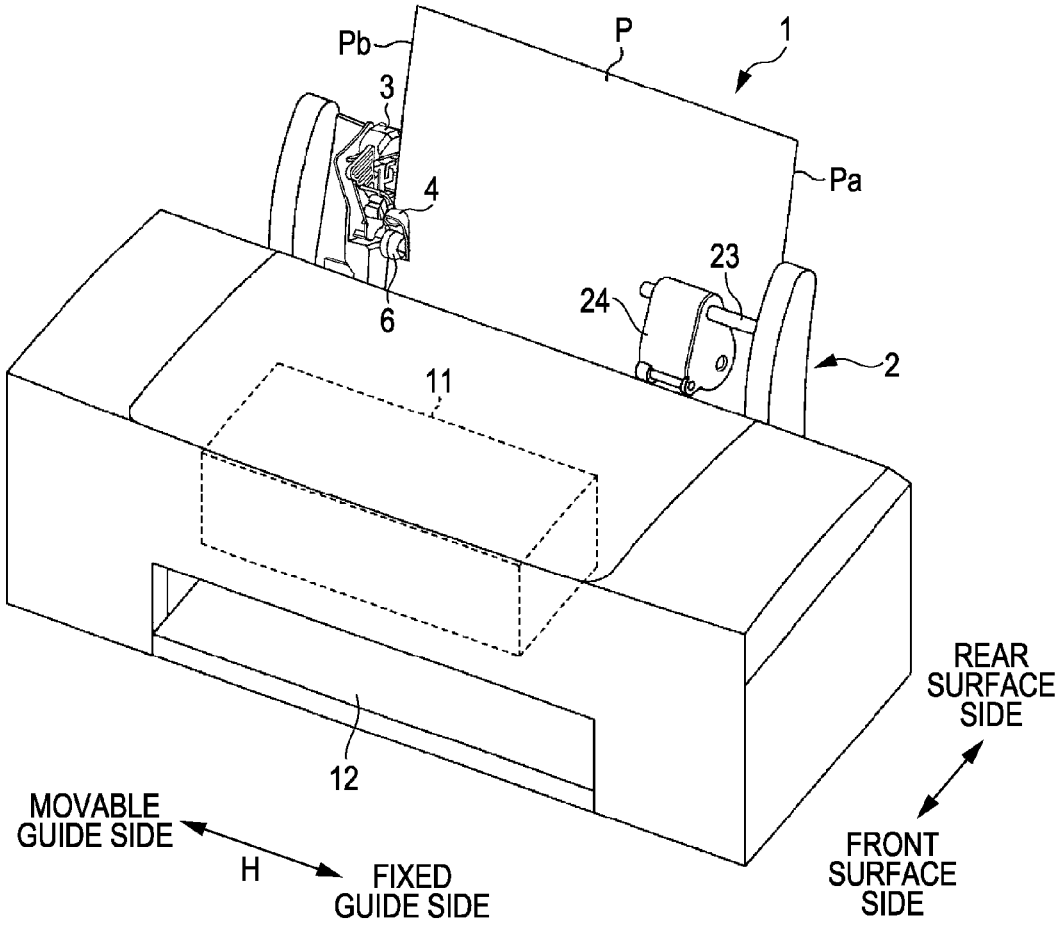
FIG. 1 is a perspective view illustrating an image forming apparatus according to an embodiment of the invention.

As shown in FIG. 1, a printer 1, serving as an image forming apparatus according to this embodiment, is a recording apparatus that records images onto paper P fed from the rear side of the apparatus. Note that the arrow H in the diagrams indicates the widthwise direction, which is the direction perpendicular to the direction in which the paper P is transported (that is, a transport direction).

The printer 1 includes a paper supply apparatus 2, which is an auto sheet feeder (ASF); an image forming unit 11 that forms an image onto the paper P fed from the paper supply apparatus 2; and a discharge opening 12 through which the paper P onto which an image has been formed by the image forming unit 11 is discharged. Sides Pa and Pb in the widthwise direction H of the paper P transported by the paper supply apparatus 2 are guided by a pair of edge guides.

Figure 2:
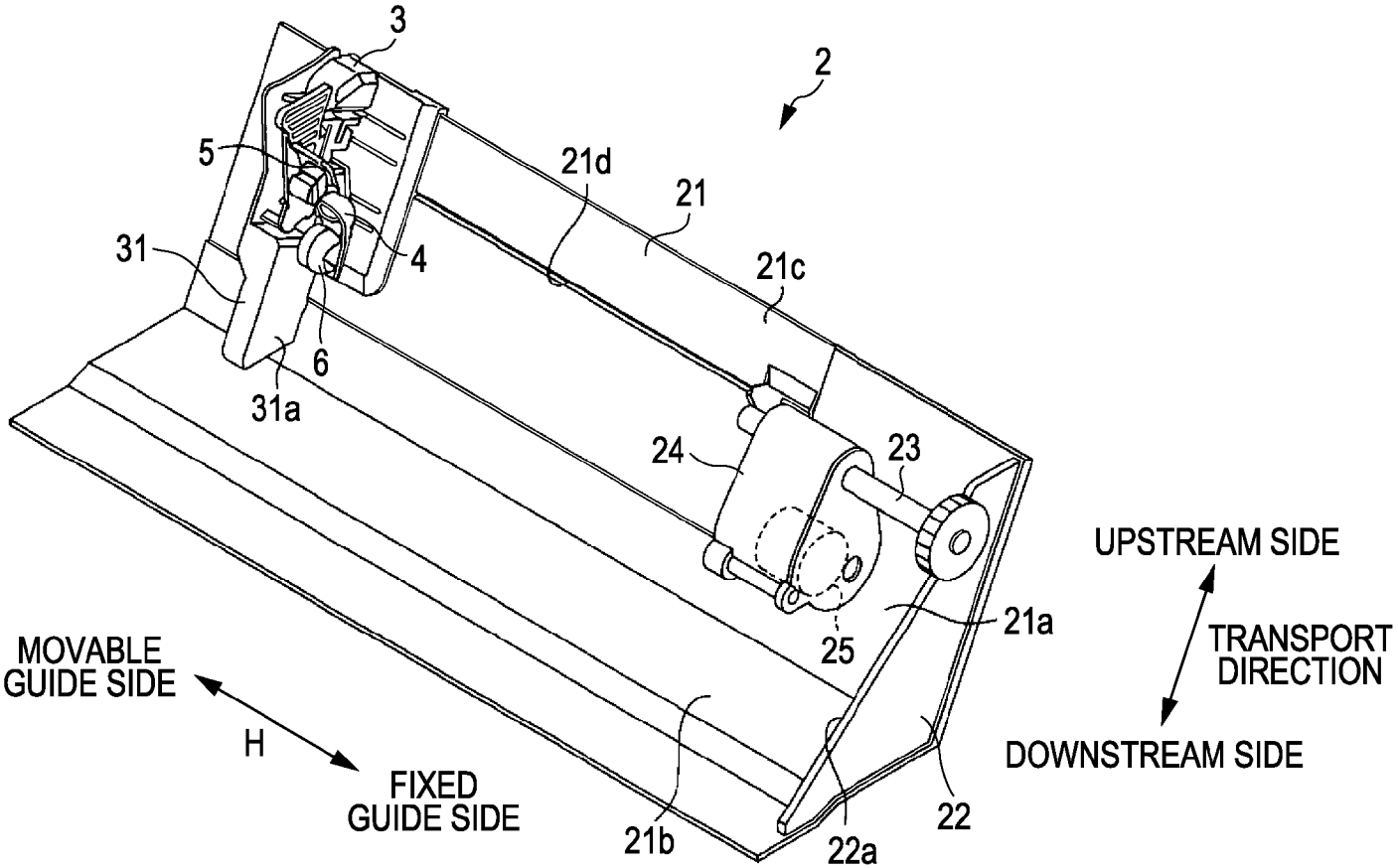
FIG. 2 is a perspective view illustrating a paper supply apparatus according to the embodiment.
Figure 3:
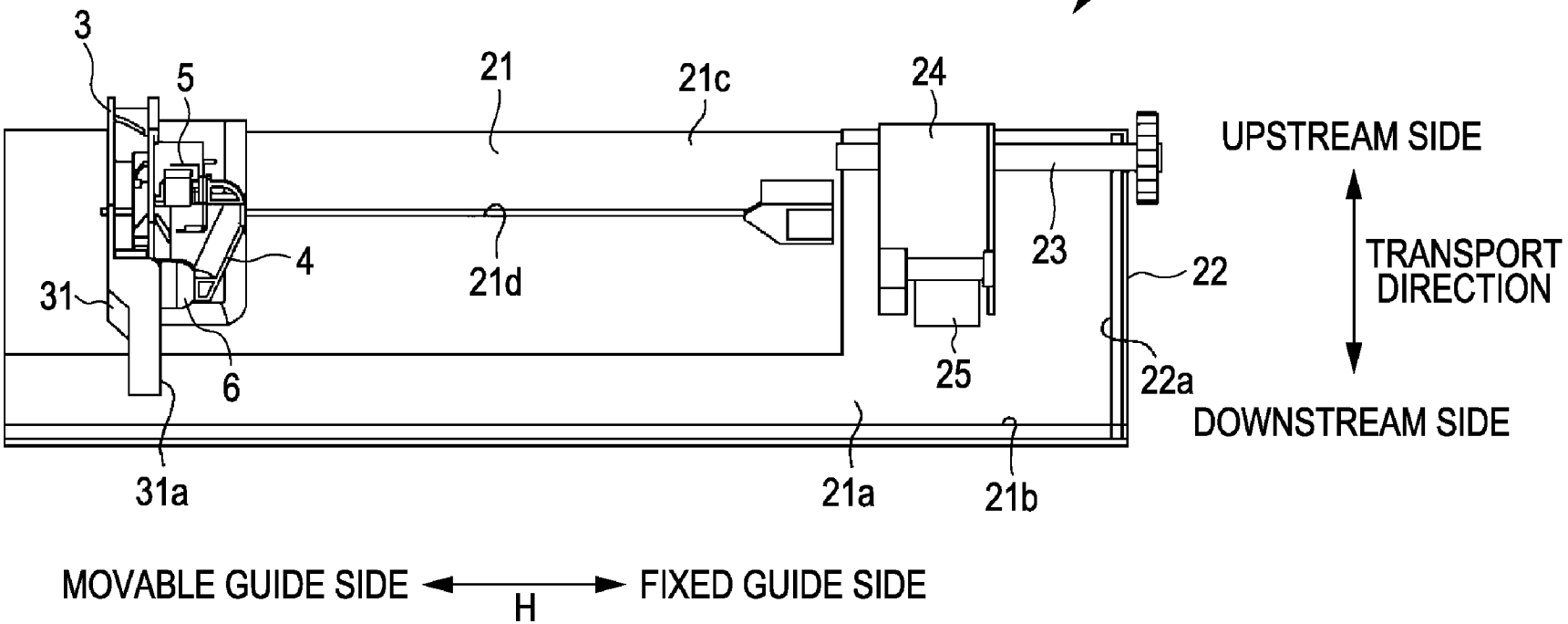
FIG. 3 is a front view illustrating the paper supply apparatus according to the embodiment.

As shown in FIGS. 2 and 3, the paper supply apparatus 2 includes: a paper supply tray 21 that receives the paper P; a fixed guide 22 that is fixed relative to the paper supply tray 21; a support shaft 23 that is connected to an electric motor (not shown); a pickup unit 24 supported by the support shaft 23; and a paper supply roller 25 provided at the lower side of the pickup unit 24.

The paper supply tray 21 has a tilted placement surface 21*a* on which the paper P is placed, and an approximately horizontal support surface 21*b* that supports the bottom end of the paper P when the paper P is placed in a tilted state on the placement surface 21*a*. The paper supply tray 21 also has a sliding surface 21*c* in which part of the placement surface 21*a* is recessed, and a groove 21*d* is provided in the sliding surface 21*c*, extending in the widthwise direction H.

The fixed guide 22 is an edge guide that guides the transport of the paper P by making contact with the one side Pa, in the widthwise direction H, of the paper P, and is provided on one end, in the widthwise direction H, of the paper supply tray 21. The fixed guide 22 has a guide surface 22*a* that extends in the transport direction and is perpendicular to the placement surface 21*a*, and the paper P is suppressed from being transported in a state in which the paper P is tilted relative to the transport direction by the one side Pa of the paper P making contact with the guide surface 22*a* while the paper P is transported.

The support shaft 23 is provided so as to protrude from the fixed guide 22. Gears (not shown) that transmit the rotation of the support shaft 23 to the paper supply roller 25 are provided within the pickup unit 24 that is in turn provided on the end of the support shaft 23.

The paper supply roller 25 is a rotational member, made of rubber, that is rotationally driven while making contact with a paper surface (that is, the surface of the paper P) on the side on which the fixed guide 22 is located, and is provided at the lower end of the pickup unit 24. The paper supply roller 25 is biased toward the placement surface 21*a* along with the pickup unit 24, and when the support shaft 23 rotates as a result of driving by an electric motor, the paper supply roller 25 rotates as well. Accordingly, the paper P that abuts the paper supply roller 25 is transported from an upstream side to a downstream side in the transport direction by driving the electric motor in a state in which the paper P is placed on the placement surface 21*a*.

Meanwhile, the paper supply apparatus 2 includes: a movable guide 3 whose distance to the fixed guide 22 in the widthwise direction H of the paper P can be adjusted; a support member 4 provided in the movable guide 3; a torsion coil spring 5 installed on the movable guide 3 and the support member 4; and an abutment roller 6 supported by the support member 4 in a rotatable state.

Figure 4:
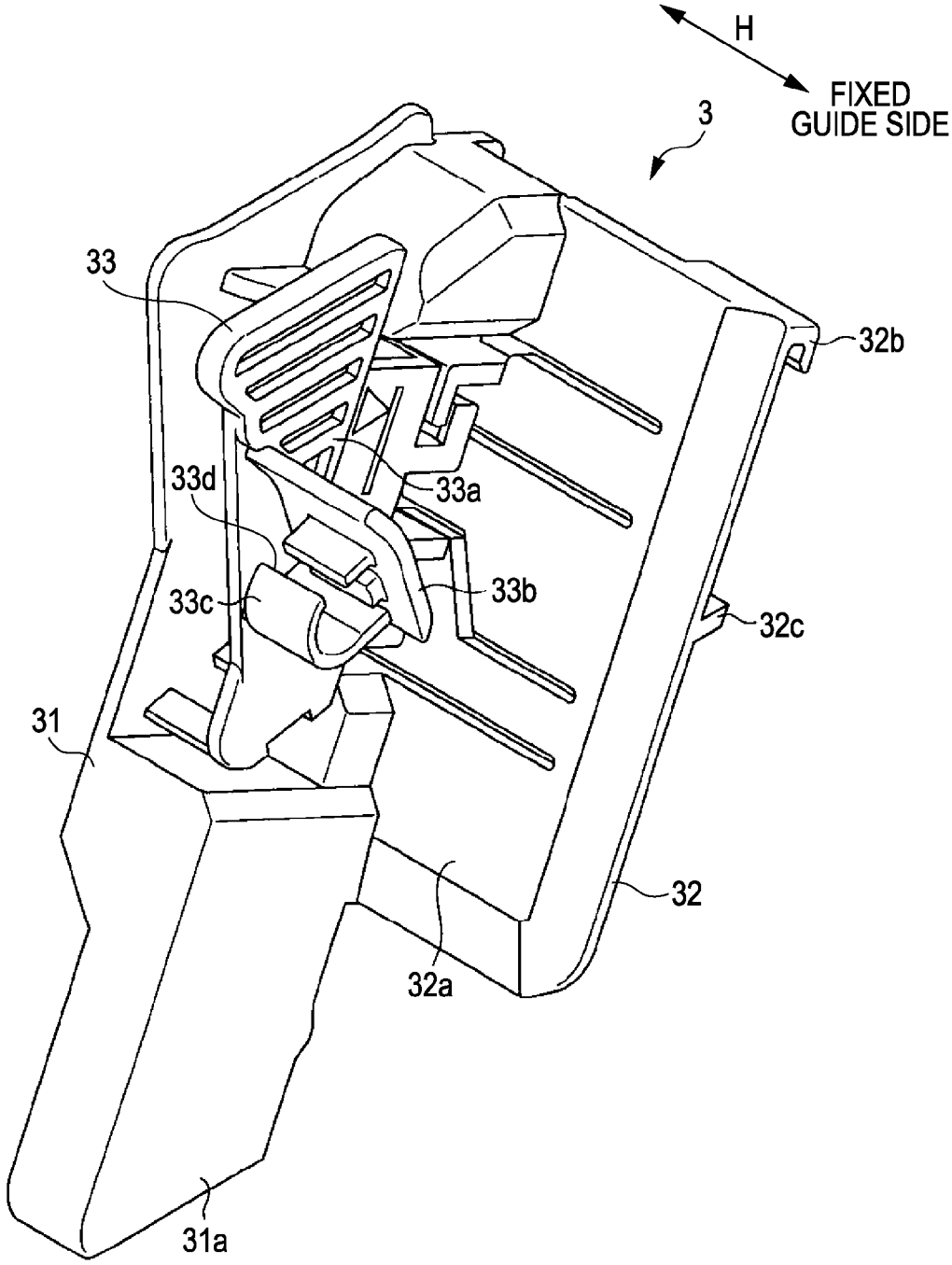
FIG. 4 is a perspective view illustrating a movable guide according to the embodiment.

As shown in FIG. 4, the movable guide 3 is an edge guide that guides the transport of the paper P while making contact with the other side Pb, in the widthwise direction H, of the paper P, and is provided in the paper supply tray 21 so that the distance between the movable guide 3 and the fixed guide 22 can be adjusted. The movable guide 3 includes: a main guide body 31 erected relative to the placement surface 21*a*; a sliding portion 32 that moves by sliding along the sliding surface 21*c*; and a manipulation portion 33, for moving the movable guide 3, that can be depressed using a fingertip. The movable guide 3, which is formed as a single entity from the main guide body 31, the sliding portion 32, and the manipulation portion 33, is configured of a single member, using a rigid synthetic resin.

The main guide body 31 has a guide surface 31*a* that extends in the transport direction and is perpendicular to the placement surface 21*a*; by transporting the paper P with the side Pb making contact with the guide surface 31*a*, the paper P being transported in a state in which the paper P is tilted relative to the transport direction can be suppressed, as opposed to the case where only the one side Pa of the paper P makes contact with the edge guide.

The sliding portion 32 has a placement surface 32*a* onto which the transported paper is placed; the placement surface 32*a* is a surface that is parallel to the placement surface 21*a* of the paper supply tray 21 and perpendicular to the guide surface 31*a*. Meanwhile, the sliding portion 32 is provided with a stopping hook 32*b* that engages with the paper supply tray 21 in order to prevent the movable guide 3 from dropping downward, a ridge portion 32*c* provided within the groove 21*d* in the sliding surface 21*c*, and so on.

The manipulation portion 33 has a side surface 33*a* that is perpendicular to the placement surface 32*a*, in the same manner as the guide surface 31*a*. The movable guide 3 is configured so that when the manipulation portion 33 is depressed, the movable guide 3 is released from its movement restriction and can move freely in the widthwise direction H along the sliding surface 21*c*. Meanwhile, a protruding portion 33*b* that protrudes toward the fixed guide 22 and a shaft support portion 33*c* for supporting the support member 4 are provided in the manipulation portion 33. The shaft support portion 33*c* is formed on the protruding portion 33*b*, and forms, along with part of the protruding portion 33*b*, an approximately tubular shape.

Figure 5:
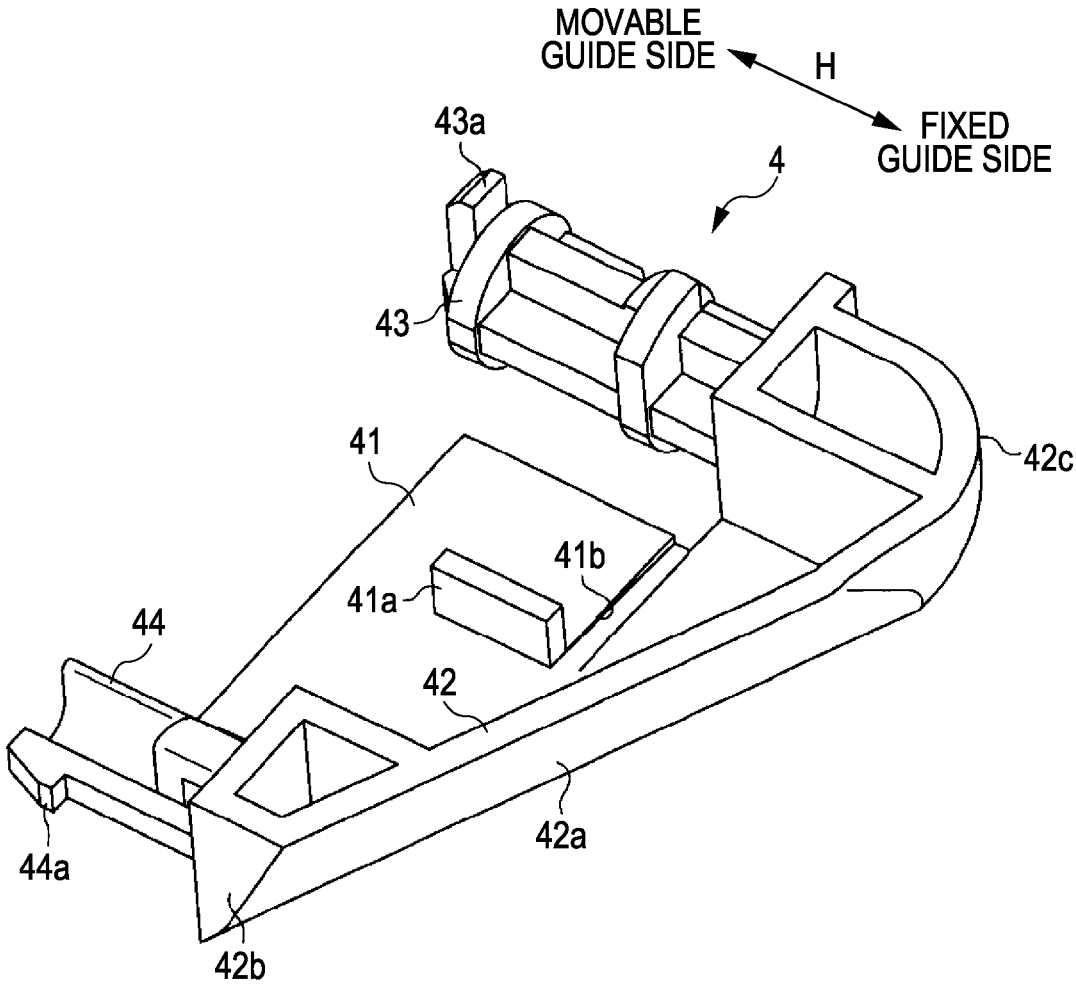
FIG. 5 is a perspective view illustrating a support member provided in the movable guide.
Figure 6:
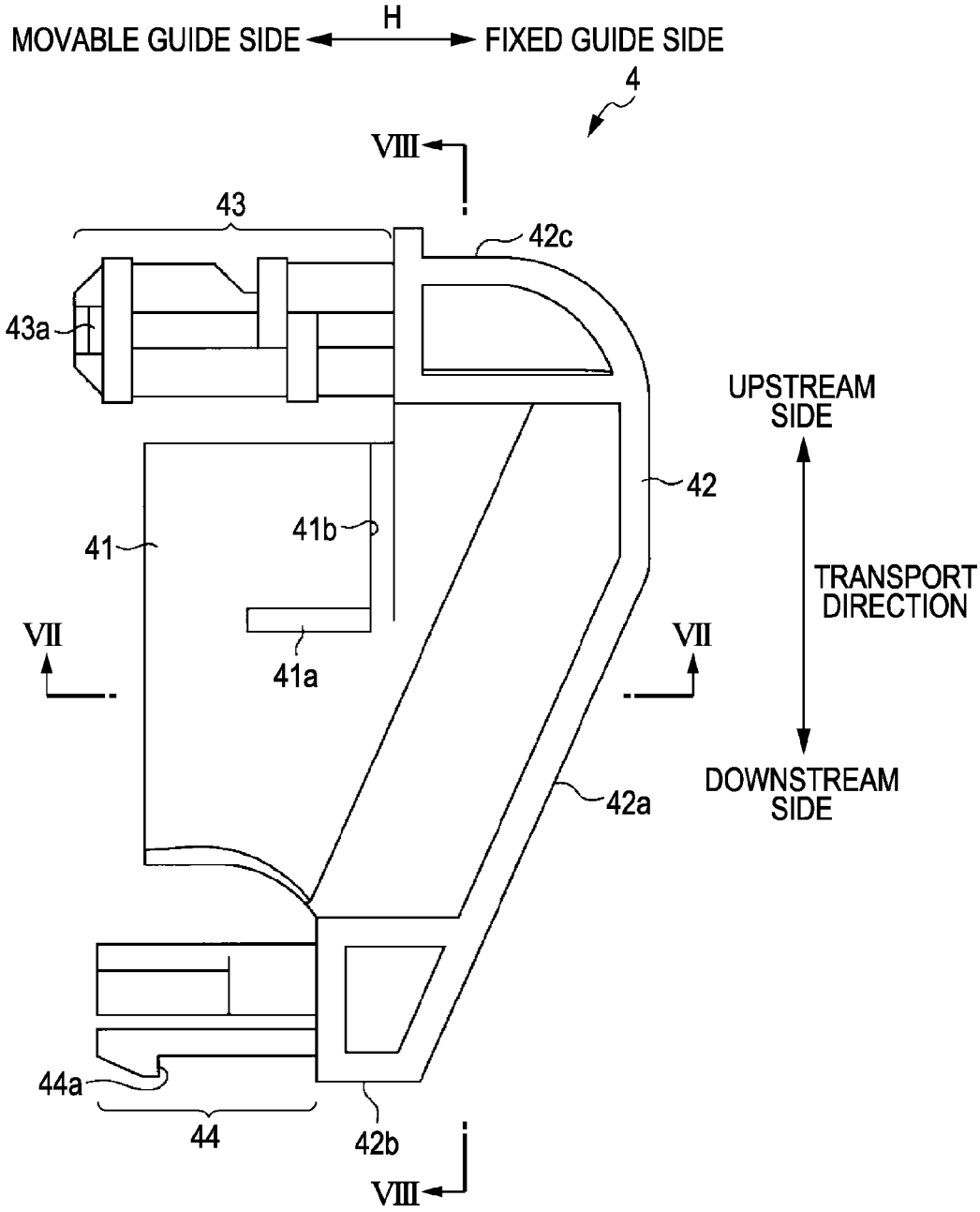
FIG. 6 is a plan view illustrating the support member provided in the movable guide.

As shown in FIGS. 5 and 6, the support member 4 includes: a plate-shaped base portion 41 that is flat in the widthwise direction H and extends in the transport direction; a side wall 42 erected from the base portion 41; and a rotation shaft 43 and a support shaft 44, both of which protrude from respective parts of the side wall 42 in the widthwise direction H, toward the side on which the movable as a single entity of the base portion 41, the side wall 42, the rotation shaft 43, and the support shaft 44, is configured of a single member, using a rigid synthetic resin.

An engagement convex portion 41*a* that engages with part of the torsion coil spring 5 and a guidance groove 41*b* for guiding the part of the torsion coil spring 5 toward the engagement convex portion 41*a* are provided in the base portion 41. As shown in FIG. 6, the base portion 41 is formed so as to decrease in width progressively from the upstream side to the downstream side in the transport direction.

The side wall 42 is provided in the end of the base portion 41 on the side where the fixed guide 22 is located. The side wall 42 has: a side surface 42*a* that opposes the fixed guide 22 in the widthwise direction H; a downstream side end surface 42*b* provided on the downstream side in the transport direction; and an upstream side end surface 42*c* provided on the upstream side in the transport direction.

The side surface 42*a*, which extends in the transport direction, connects the downstream side end surface 42*b* and the upstream side end surface 42*c*, and the upstream side end surface 42*c* extends further toward the fixed guide 22 than the downstream side end surface 42*b*. Accordingly, the side surface 42*a* protrudes toward the fixed guide 22 progressively more from the downstream side to the upstream side in the transport direction.

Figure 7:
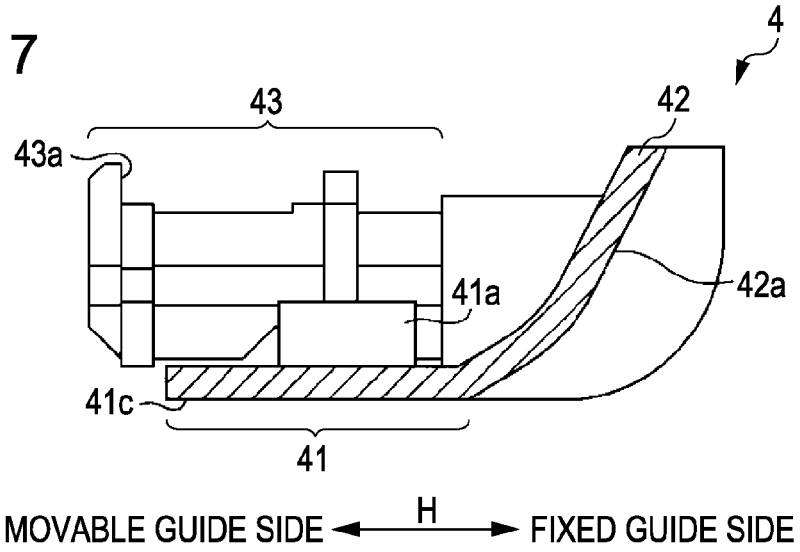
FIG. 7 is a cross-section viewed along the VII-VII line shown in FIG. 6.

Furthermore, as shown in FIGS. 5 and 7, the side surface 42*a* is provided in a sloped state. To be more specific, the side surface 42*a* is formed in a sloped shape so that portions thereof that are closer to the fixed guide 22 in the widthwise direction H are distanced further from the placement surface 32*a*. The sloped side surface 42*a*, provided as described in the support member 4, is provided so as to oppose the placement surface 32*a* of the movable guide 3. Through such a configuration, when the paper P is inserted between the placement surface 32*a* and the abutment roller 6, the paper P can be guided into the space between the placement surface 32*a* and the abutment roller 6 from the side on which the fixed guide 22 is located, along the side surface 42*a* of the support member 4.

Figure 8:
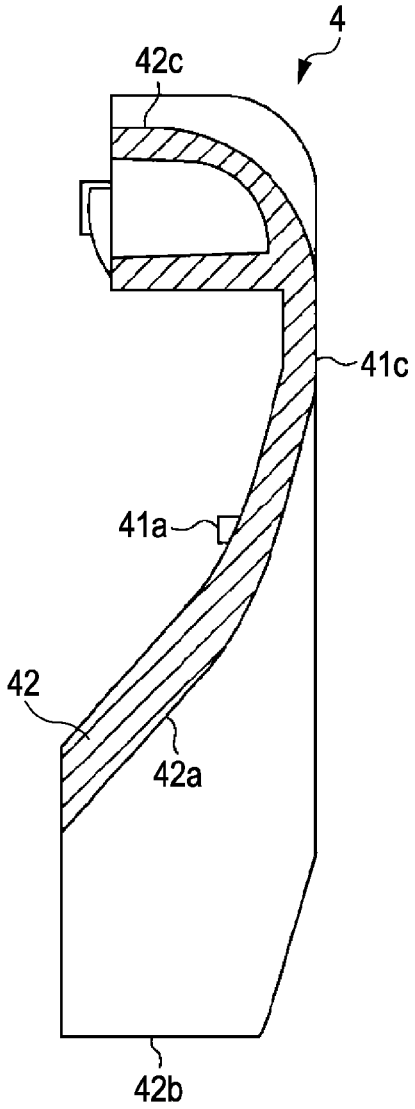
FIG. 8 is a cross-section viewed along the VIII-VIII line shown in FIG. 6.

Furthermore, as shown in FIG. 8, the upstream side end surface 42*c* is connected, in a curved manner, to a bottom surface 41*c* provided in the base portion 41 of the support member 4. The bottom surface 41*c* is a flat plane provided facing the placement surface 32*a*. Accordingly, the upstream side end surface 42*c* of the side wall 42 forms a convex surface on the side where the fixed guide 22 is located in the widthwise direction H and in the upstream side end in the transport direction. According to such a configuration, the paper P can be inserted between the placement surface 32*a* and the support member 4 with ease from the upstream side of the support member 4 in the transport direction.

The rotation shaft 43 is formed in the transport direction so as to protrude from the side wall 42 on the upstream side toward the side where the movable guide 3 is located. By supporting the rotation shaft 43 using the shaft support portion 33*c*, the support member 4 is provided so as to be capable of freely rotating relative to the movable guide 3. A stopping convex portion 43*a* that engages with the shaft support portion 33*c* and stops the movement of the rotation shaft 43 in the direction of the fixed guide 22 is provided in the end of the rotation shaft 43, so as to prevent the rotation shaft 43 from falling from the shaft support portion 33*c*. Note that an opening 33*d* is provided in the shaft support portion 33*c* so that the shaft support portion 33*c* and the stopping convex portion 43*a* do not interfere with each other when the rotation shaft 43 is attached by inserting the rotation shaft 43 into the shaft support portion 33*c* from the side where the fixed guide 22 is located.

The support shaft 44 is formed in the transport direction so as to protrude from the side wall 42 on the downstream side toward the side where the movable guide 3 is located, and is formed in a partially-cylindrical shape. By attaching the abutment roller 6 to the support shaft 44, the abutment roller 6 is supported by the support member 4 so as to be capable of rotation. A stopping convex portion 44*a* that stops the movement of the abutment roller 6 in the direction of the movable guide 3 is provided in the end of the support shaft 44, so as to prevent the abutment roller 6 from falling from the support shaft 44. The support shaft 44 is formed so as to be capable of elastic deformation, and the abutment roller 6 is fitted into the support shaft 44 from the movable guide 3 side causing the support shaft 44 to elastically deform.

Figure 9:
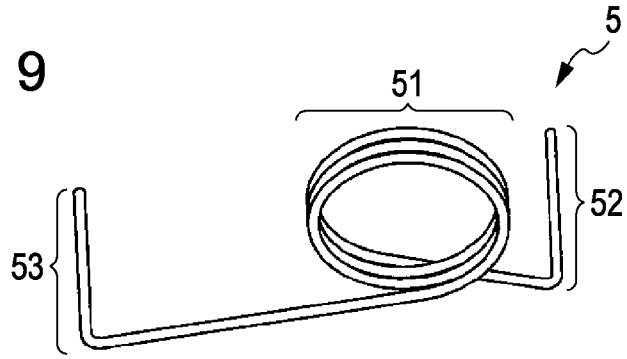
FIG. 9 is a perspective view illustrating an elastic member provided in the movable guide and the support member.

As shown in FIG. 9, the torsion coil spring 5 is formed of a wire material such as a stainless steel wire, and has a coil portion 51 formed by coiling the wire material. One end 52 of the wire material is formed in a shape that is capable of engaging with the movable guide 3, whereas the other end 53 of the wire material is formed in a shape that is capable of engaging with the support member 4. The coil portion 51 is fitted into the rotation shaft 43 of the support member 4.

Figure 10A:
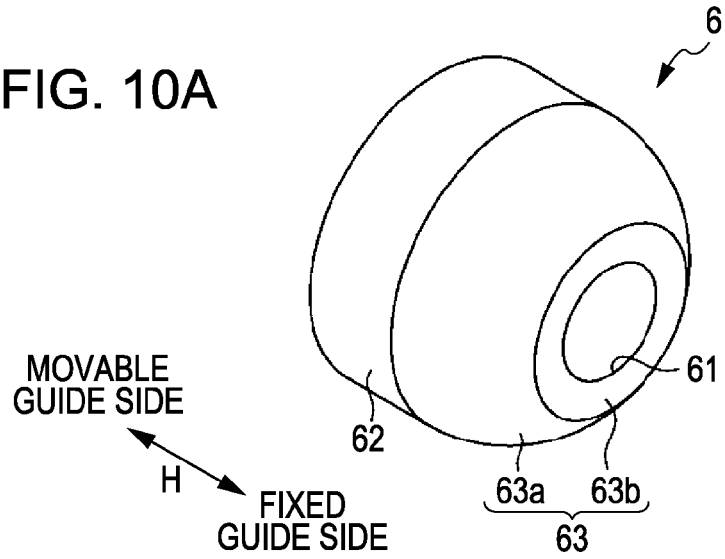
FIGS. 10A and 10B are perspective views illustrating an abutment member provided in the support member.
Figure 10B:
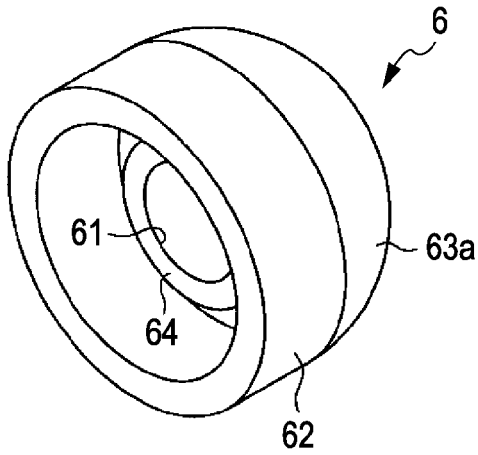

As shown in FIGS. 10A and 10B, the abutment roller 6 is a molded article, configured of a rigid synthetic resin, in which a through-hole 61, into which the support shaft 44 is inserted, is formed. The abutment roller 6 has an abutment surface 62, shaped as a cylindrical surface, that abuts the surface of the paper P; a convex surface 63*a* and an end surface 63*b* that together serve as a side surface 63, which opposes the fixed guide 22 in the widthwise direction H; and an engagement surface 64 that engages with the stopping convex portion 44*a*.

The convex surface 63*a* of which the side surface 63 is configured is provided so as to be slanted relative to the placement surface 32*a*. To be more specific, the side surface 63 is formed in a sloped shape so that portions thereof that are closer to the fixed guide 22 in the widthwise direction H are distanced further from the placement surface 32*a*, and the convex surface 63*a* serves as a surface of the abutment roller 6 whose diameter decreases as the surface progresses toward the fixed guide 22. Through such a configuration, when the paper P is placed upon the placement surface 32*a* onto which the abutment roller 6 is biased, the paper P can be inserted from the side where the fixed guide 22 is located, along the convex surface 63*a* that serves as the side surface 63 of the abutment roller 6, and into the space between the placement surface 32*a* and the abutment roller 6 with ease. Accordingly, interference between the paper P inserted from the side where the fixed guide 22 is located and the convex surface 63*a* of the abutment roller 6 can be suppressed even in the case where the abutment roller 6 is biased toward the placement surface 32*a*, which makes it possible to place the paper P on the placement surface 32*a* with ease.

Figure 11:
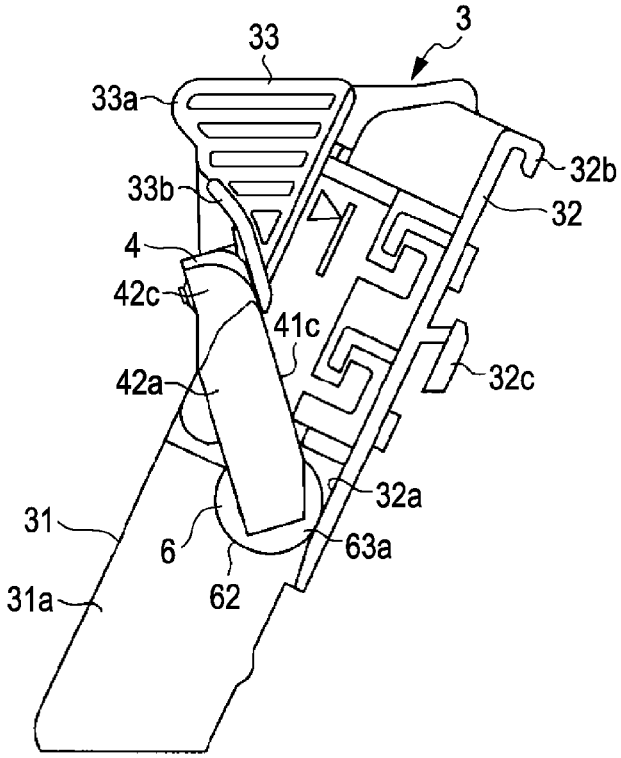
FIG. 11 is a side view illustrating the movable guide unit.
Figure 12:
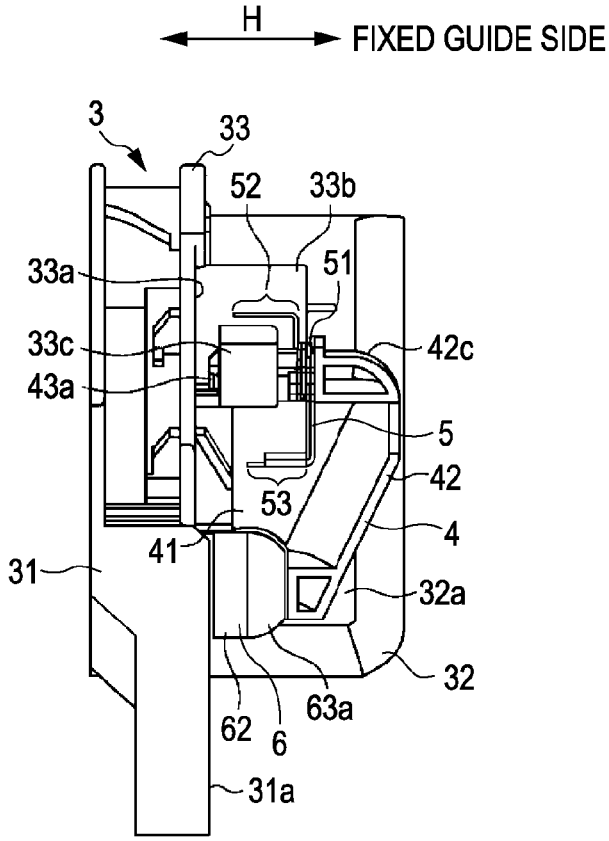
FIG. 12 is a front view illustrating the movable guide unit.

As shown in FIGS. 11 and 12, the support member 4, the torsion coil spring 5, and the abutment roller 6 are anchored to the movable guide 3, and a movable guide unit configured of the movable guide 3, the support member 4, the torsion coil spring 5, and the abutment roller 6 is capable of adjusting the distance to the fixed guide 22 in the widthwise direction H of the paper P.

As described thus far, the paper supply apparatus 2 includes the placement surfaces 21*a* and 32*a*, the fixed guide 22 that abuts the one side Pa of the paper P, the movable guide 3 whose distance to the fixed guide 22 can be adjusted and that abuts the other side Pb of the paper P, and the paper supply roller 25 that abuts the surface of the paper P in a position between the fixed guide 22 and the movable guide 3 on the side where the fixed guide 22 is located.

Next, the manner in which the paper supply roller 25 and the abutment roller 6 abuts the surface of the paper P and the manner in which the paper P is transported will be described with reference to FIGS. 13 and 14. The two-dot-dash line L in FIG. 13 indicates the transport path of the paper P in the case where a single sheet of paper P has been placed upon the placement surface 32*a*. Meanwhile, the two-dot-dash line L in FIG. 14 indicates the transport path of the uppermost sheet of paper P in the case where the maximum number of sheets of paper P that can be loaded has been placed upon the placement surface 32*a*.

Figure 13:
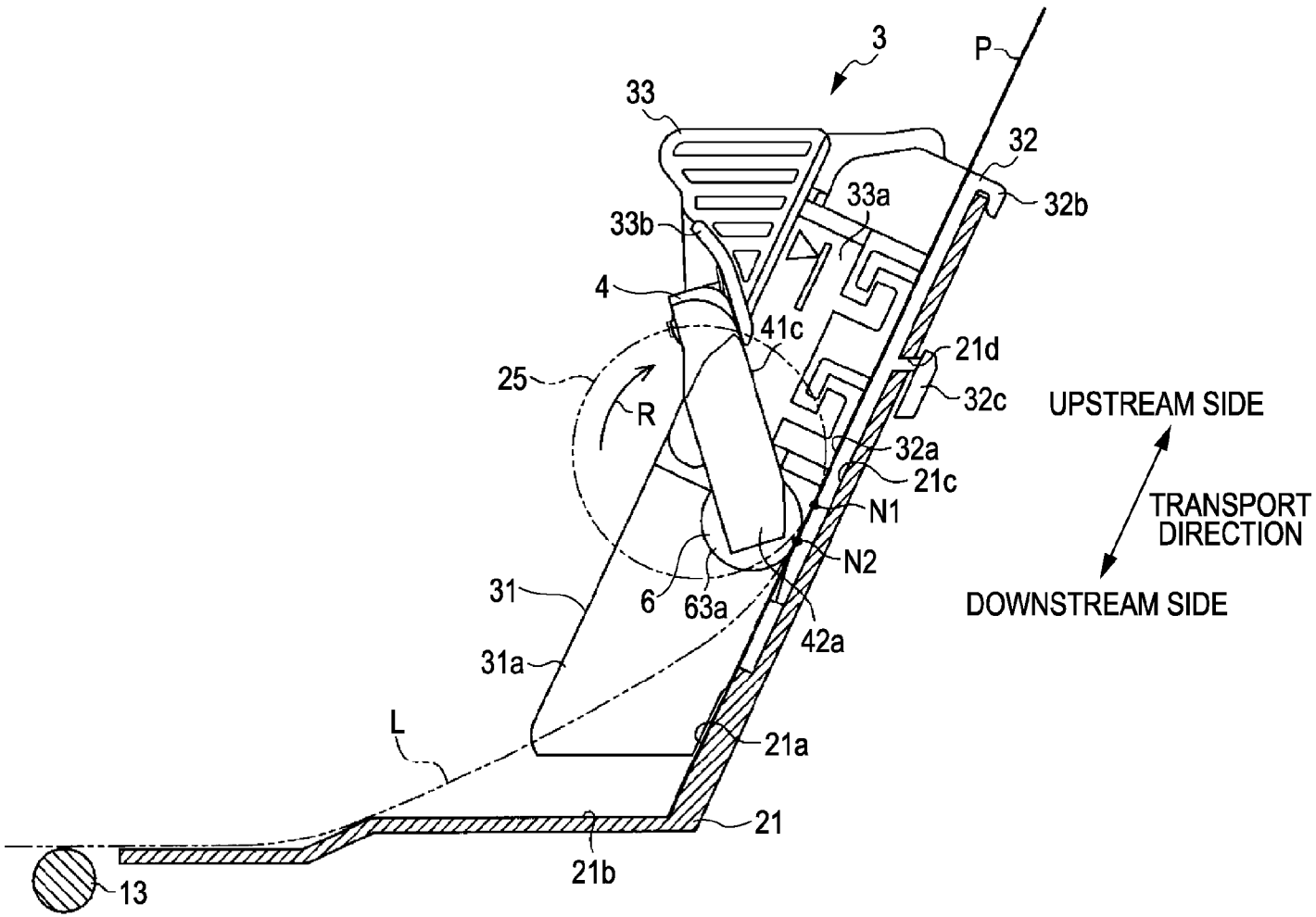
FIG. 13 is a side view of the movable guide unit in a state in which a small amount of paper has been placed on a placement surface, and is a cross-sectional view of an image forming apparatus for illustrating the manner in which the paper is transported.
Figure 14:
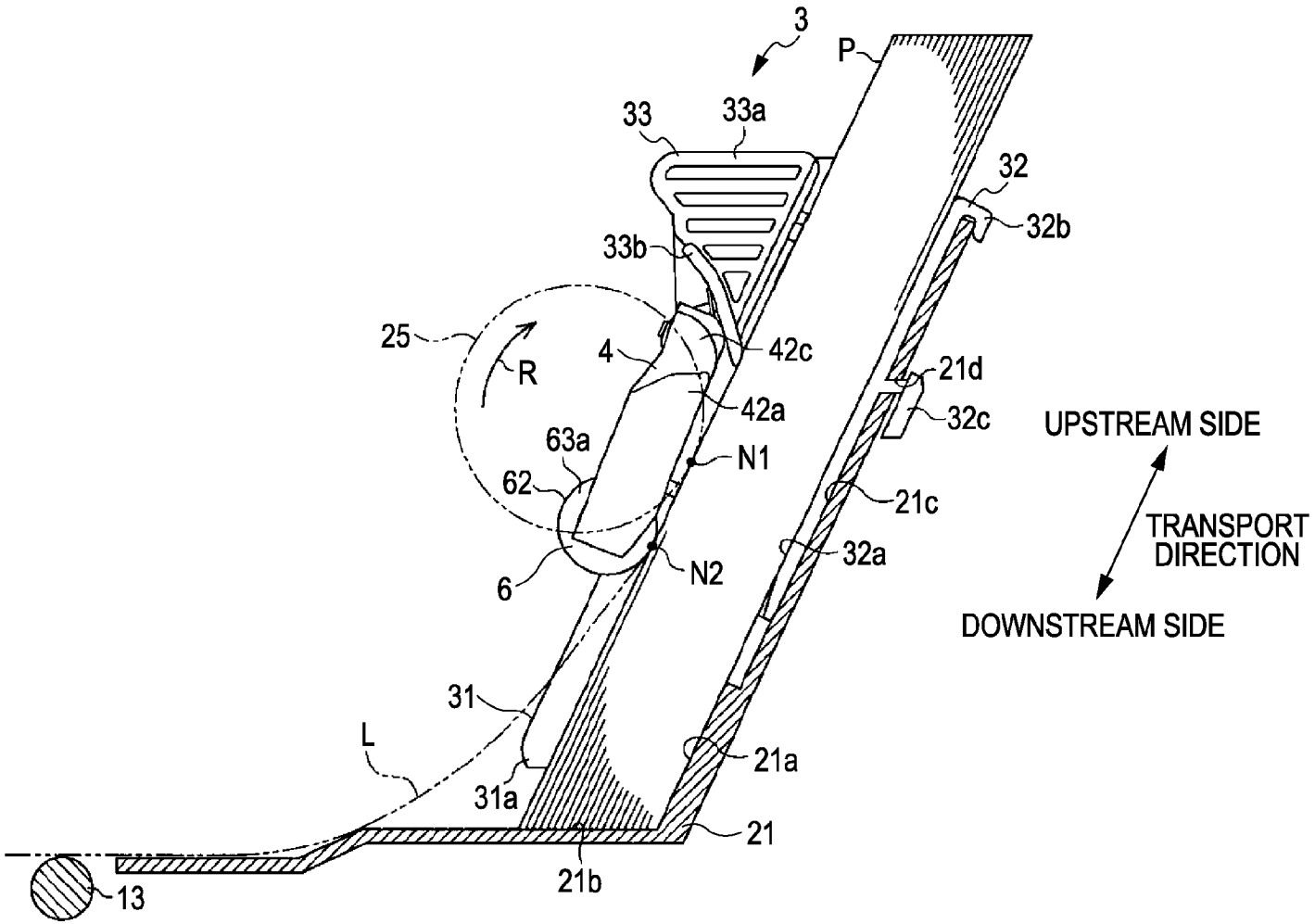
FIG. 14 is a side view of the movable guide unit in a state in which a large amount of paper has been placed on the placement surface, and is a cross-sectional view of the image forming apparatus for illustrating the manner in which the paper is transported.

As shown in FIGS. 13 and 14, the abutment roller 6 is biased toward the placement surface 32*a* along with the support member 4, and in this embodiment, the configuration is such that the abutment surface 62 of the abutment roller 6 abuts the surface of the paper P regardless of how many sheets of paper P are placed on the placement surface 32*a*.

When the paper supply roller 25 rotates in the direction indicated by the arrow R, the paper P is transported from the upstream side to the downstream side in the transport direction. Furthermore, a PF (paper feed) roller 13 provided downstream from the paper supply roller 25 in the transport direction is also connected to the electric motor and rotates, in the same manner as the paper supply roller 25. Note that in the case where the paper P is transported at a high speed relative to the image forming unit 11, it is preferable for the PF roller 13 to be caused to rotate and effect force upon the paper P toward the upstream side in the transport direction. To be more specific, in the case where the PF roller 13 abuts the surface of the paper P on the opposite side of the paper P as the paper supply roller 25 abuts therewith, the PF roller 13 may be caused to rotate in the same direction as the paper supply roller 25.

Here, in this embodiment, the abutment roller 6 is disposed so that an abutment point N2 (second abutment point), where the abutment roller 6 abuts the surface of the paper P, is further downstream in the transport direction of the paper P than an abutment point N1 (first abutment point), where the paper supply roller 25 abuts the surface of the paper P. In other words, the abutment point N2, where the abutment roller 6 abuts the surface of the paper P, is further downstream in the transport direction of the paper P than the abutment point N1, where the paper supply roller 25 abuts the surface of the paper P.

The distance in the transport direction between the abutment point N1 and the abutment point N2 may be set to, for example, 2 mm or more. In this embodiment, as shown in FIGS. 13 and 14, the more sheets of paper P are placed upon the placement surface 32*a*, the greater the distance between the abutment point N1 and the abutment point N2 becomes, and thus the configuration is such that when only a single sheet of paper P is placed upon the placement surface 32*a*, as shown in FIG. 13, the distance between the abutment point N1 and the abutment point N2 is 2 mm.

According to this embodiment, the following effects can be obtained.

Figure 15:
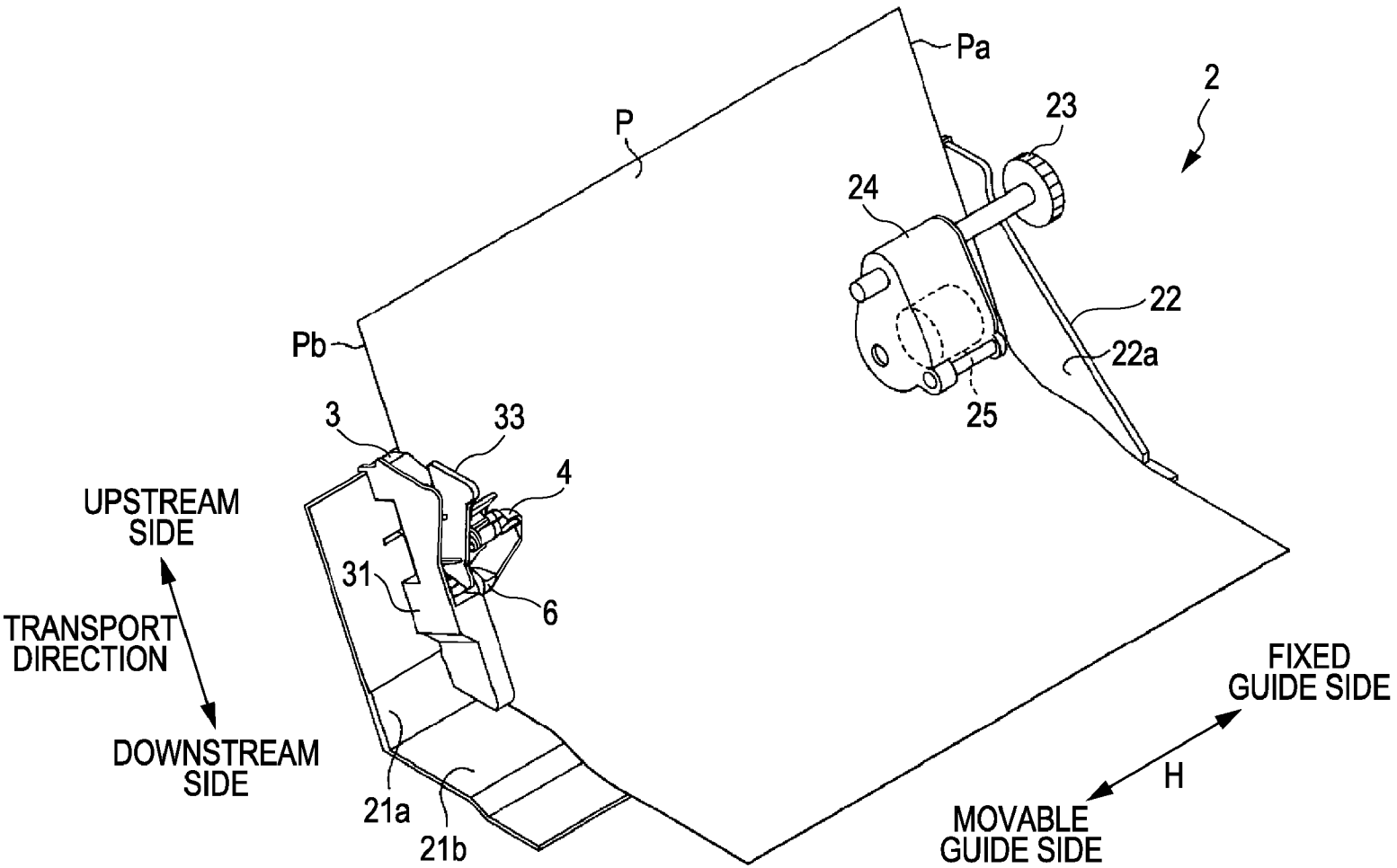
FIG. 15 is a diagram illustrating the manner in which paper is transported, and is a perspective view illustrating a paper supply apparatus according to an embodiment of the invention.
Figure 16:
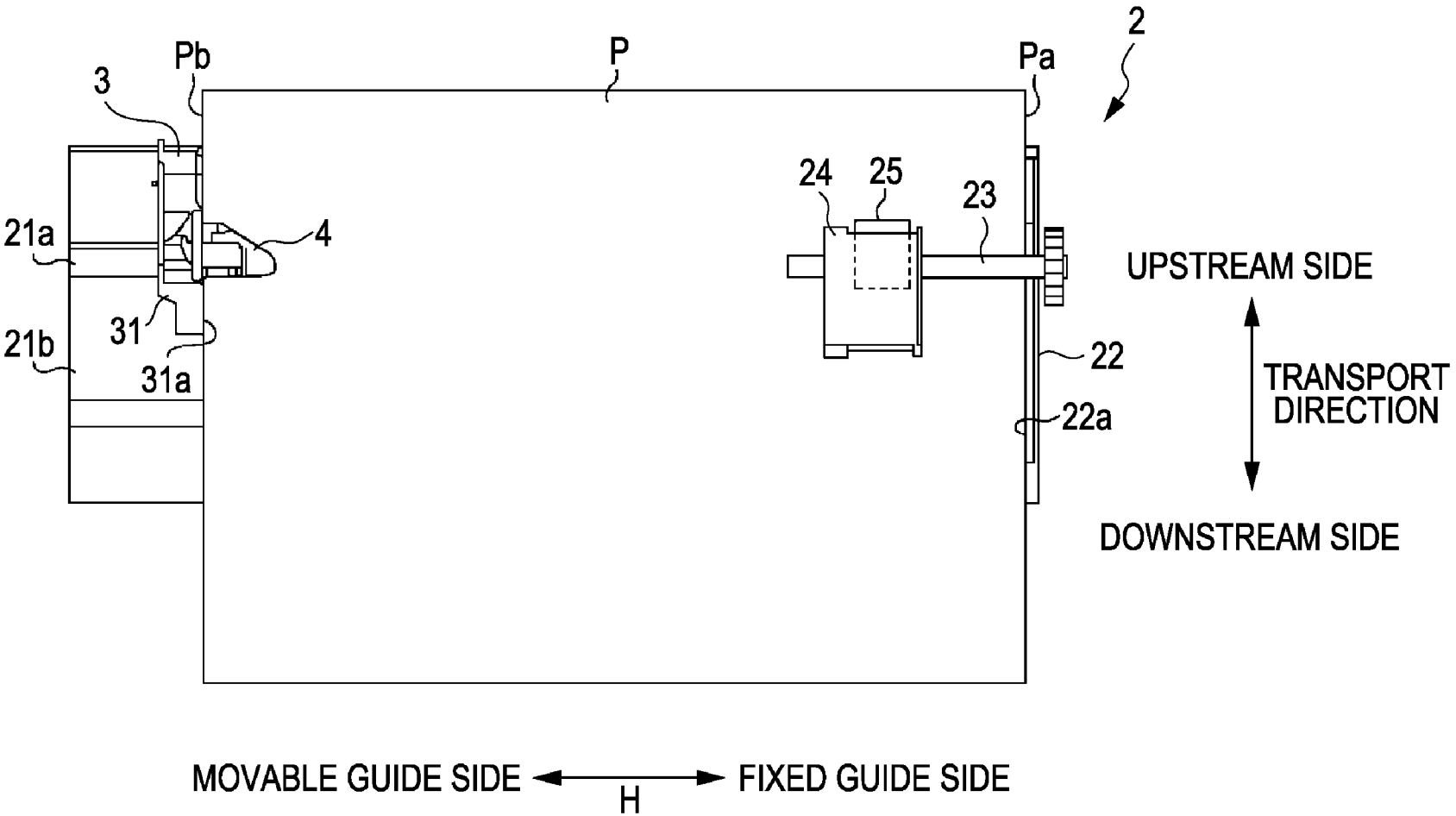
FIG. 16 is a diagram illustrating the manner in which paper is transported, and is a plan view illustrating a paper supply apparatus according to an embodiment of the invention.

(1) The paper supply apparatus 2 includes the abutment roller 6, which is provided on the movable guide 3 and abuts the surface of the paper P, and the torsion coil spring 5, which biases the abutment roller 6 toward the placement surface 32*a*. As a result, not only is the surface of the paper P held down by the paper supply roller 25 at a position on the side where the fixed guide 22 is located, but the surface of the paper P can also be held down by the abutment roller 6 at a position on the side where the movable guide 3 is located. Accordingly, as shown in FIGS. 15 and 16, both sides of the paper P in the widthwise direction H can be suppressed from lifting off even when highly-elastic heavy paper P is transported, which in turn makes it possible to suppress the paper P from being transported in a state in which the paper P is tilted relative to the transport direction.

(2) The abutment roller 6 is disposed so that the abutment point N2, where the abutment roller 6 abuts the surface of the paper P, is further downstream in the transport direction of the paper P than the abutment point N1, where the paper supply roller 25 abuts the surface of the paper P. As a result, the abutment roller 6 can be caused to abut the surface of the paper P with a weaker force than the force with which the paper supply roller 25 is caused to abut the surface of the paper P. Accordingly, the strength of the abutment roller 6 can be ensured without damaging the abutment roller 6 that is biased toward the placement surface 32*a*.

(3) The paper supply apparatus 2 includes the support member 4, which supports the abutment roller 6 so as to be capable of free rotation relative to the movable guide 3; the abutment roller 6 is biased toward the placement surface 32*a* along with the support member 4. As a result, a structure that supports the support member 4 in a freely-rotatable state (in other words, the shaft support portion 33*c* that supports the rotation shaft 43 provided in the support member 4) may be formed as a configuration of the movable guide 3 for biasing the abutment roller 6 toward the placement surface 32*a*. Accordingly, in order to ensure that the abutment point N2, where the abutment roller 6 abuts the surface of the paper P, is located further downstream in the transport direction of the paper P than the abutment point N1, where the paper supply roller 25 abuts the surface of the paper P, the support member 4 may be provided extending toward the downstream side in the transport direction. As a result, it is no longer necessary to provide the movable guide 3 extending toward the downstream side in the transport direction farther than is needed, which makes it possible to reduce the size of the movable guide 3.

(4) The abutment member provided in the movable guide 3 and that abuts the surface of the paper P is the abutment roller 6, which is supported by the support member 4 so as to be capable of rotating. Accordingly, it is possible to suppress the occurrence of friction, which inhibits the transport of the paper P.

(5) The elastic member that biases the abutment roller 6 toward the placement surface 32*a* is the torsion coil spring 5 that is attached to the movable guide 3. Accordingly, the abutment roller 6 can be biased toward the placement surface 32*a* by using the torsion momentum of the torsion coil spring 5.

(6) The printer 1 includes the aforementioned paper supply apparatus 2 as well as the image forming unit 11 that forms an image upon the paper P, and thus can achieve the aforementioned effects (1) through (5); thus the printer 1 is capable of properly forming an image on the paper P by suppressing the paper P from being transported in a state in which the paper P is tilted relative to the transport direction.

Note that the aforementioned embodiment may be modified as described hereinafter.

In the aforementioned embodiment, the paper supply apparatus 2 is also capable of being applied to an image reading apparatus such as a scanner. In other words, according to an image reading apparatus that includes the paper supply apparatus 2 of the aforementioned embodiment and an image reading unit that reads an image formed upon the paper P, the same effects as those described in the aforementioned (1) through (6) can be achieved, thus making it possible to properly read an image.

In the aforementioned embodiment, the configuration may be such that the abutment surface 62 of the abutment roller 6 does not abut the surface of the paper P in the case where less than a predetermined number of sheets of paper P has been placed on the placement surface 32*a*.

Figure 17:
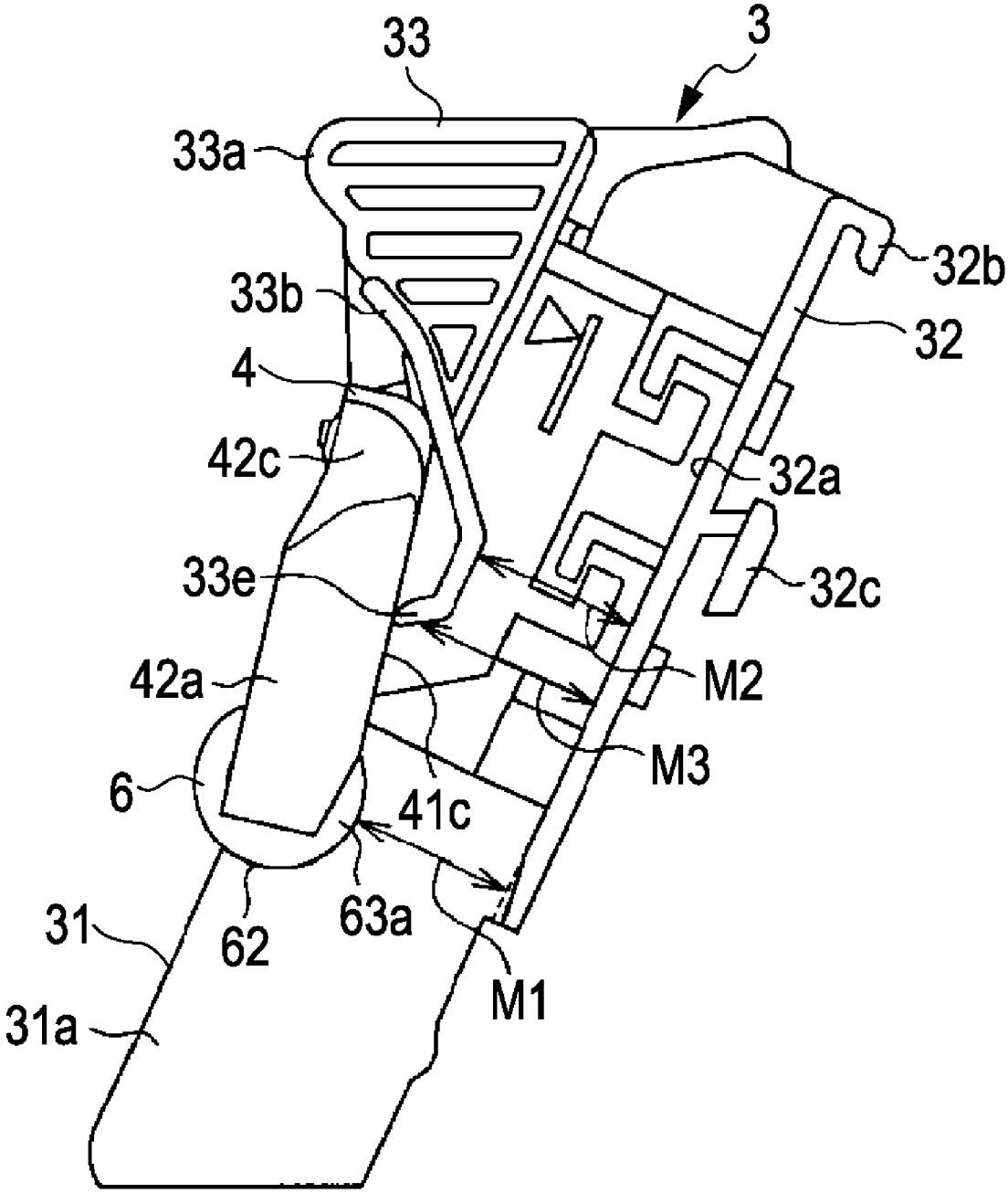
FIG. 17 is a side view illustrating a variation of a movable guide unit.

To be more specific, as shown in, for example, FIG. 17, the abutment roller 6 may be disposed in a position with a predetermined space between itself and the placement surface 32*a* by regulating the movement of the support member 4 toward the placement surface 32*a* using the protruding portion 33*b*, which is provided in the movable guide 3 and protrudes toward the fixed guide 22. According to such a configuration, the abutment roller 6 abuts the surface of the paper P if there is greater than or equal to a predetermined number of sheets of paper P placed on the placement surface 32*a*, whereas the abutment roller 6 does not abut the surface of the paper P if there are less than a predetermined number of sheets of paper P placed on the placement surface 32*a*. Accordingly, the paper P can be inserted between the placement surface 32*a* and the abutment roller 6 more easily than in the case where the abutment roller 6 is provided making contact with the placement surface 32*a*.

Figure 18:
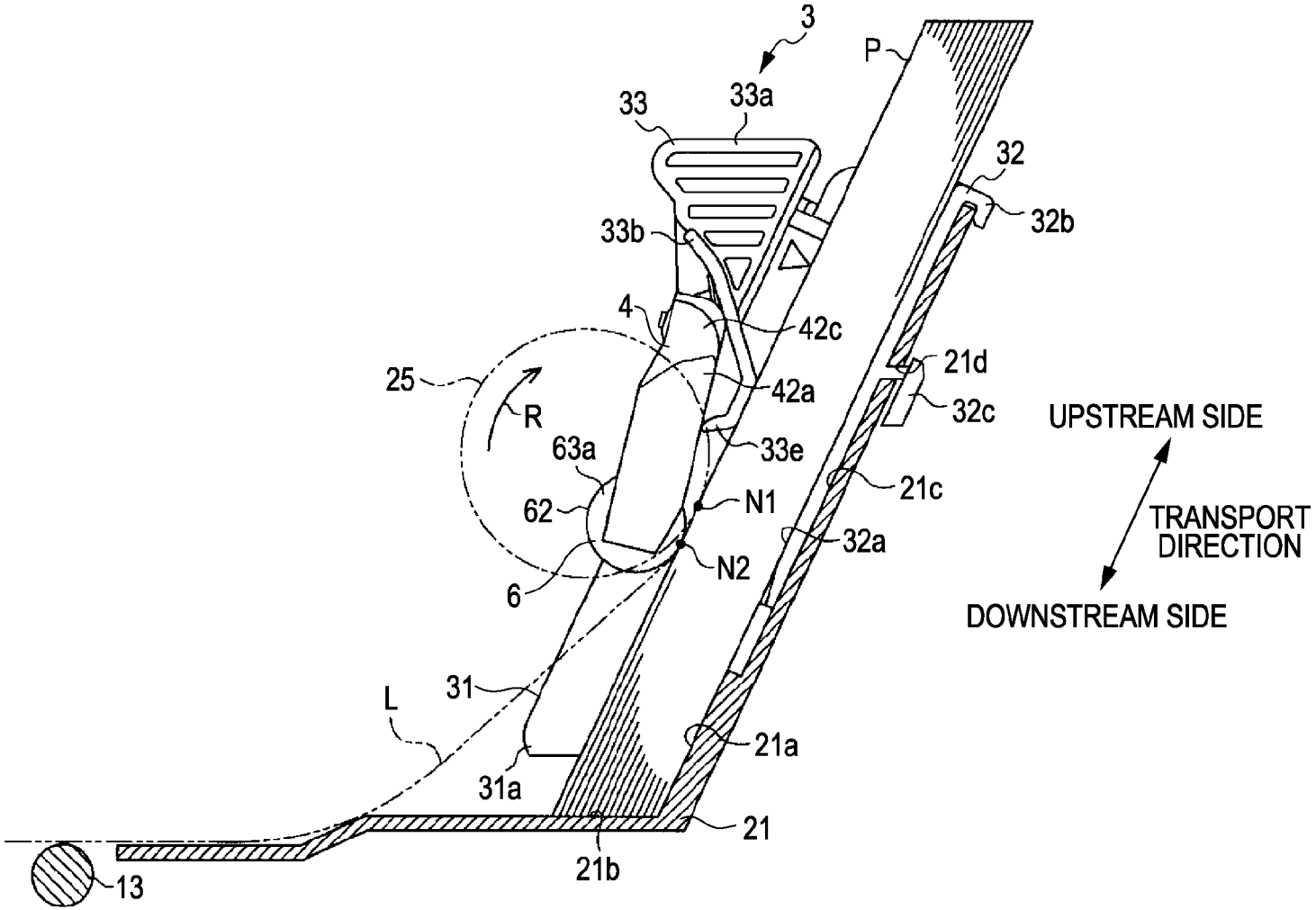
FIG. 18 is a side view of the movable guide unit, according to the variation, in a state in which paper has been placed on a placement surface, and is a cross-sectional view of an image forming apparatus for illustrating the manner in which the paper is transported.
Figure 19:
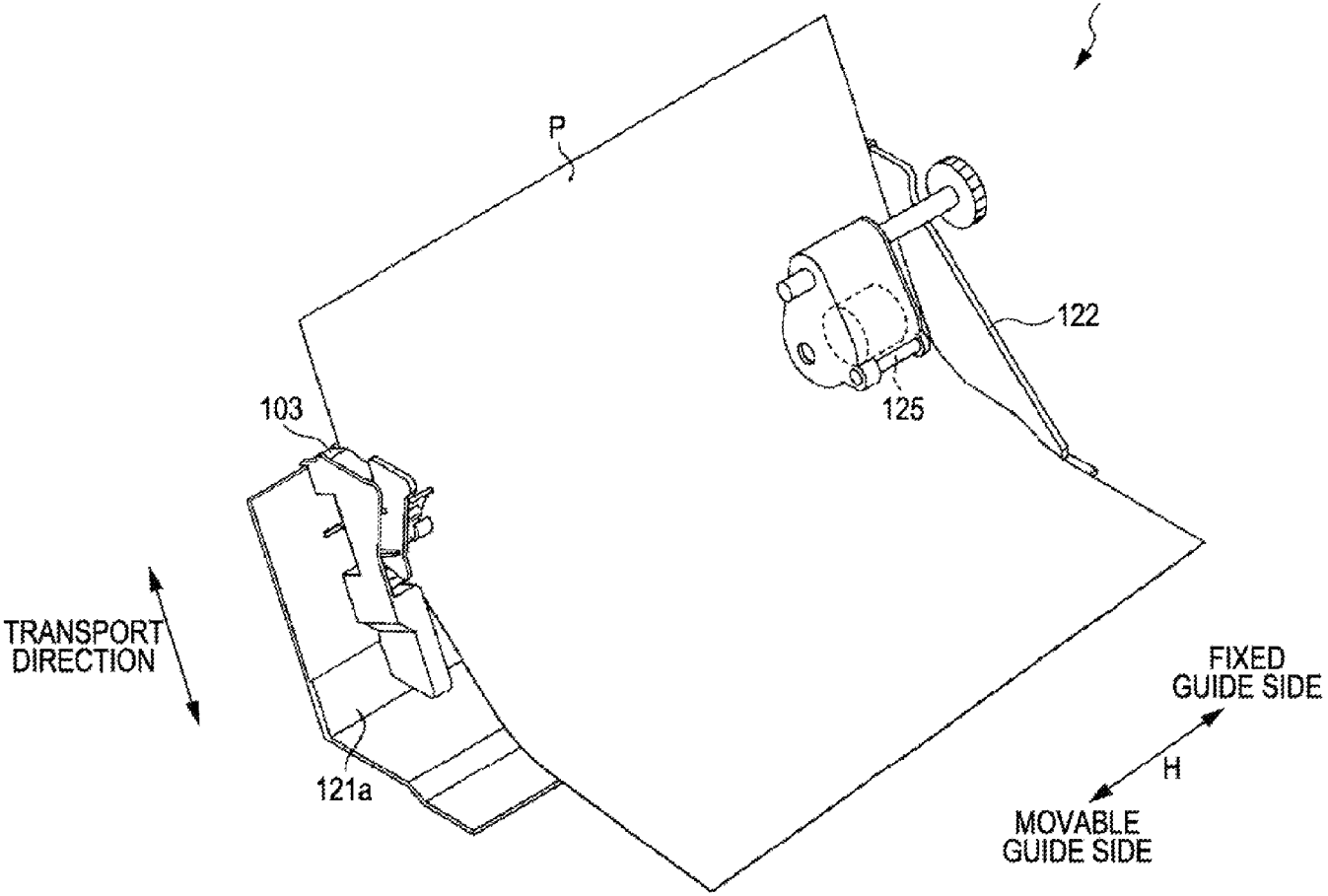
FIG. 19 (Prior Art)
FIG. 19 is a perspective view of a paper supply apparatus for illustrating the state in which paper is transported when the paper is tilted relative to the transport direction.
Figure 20:
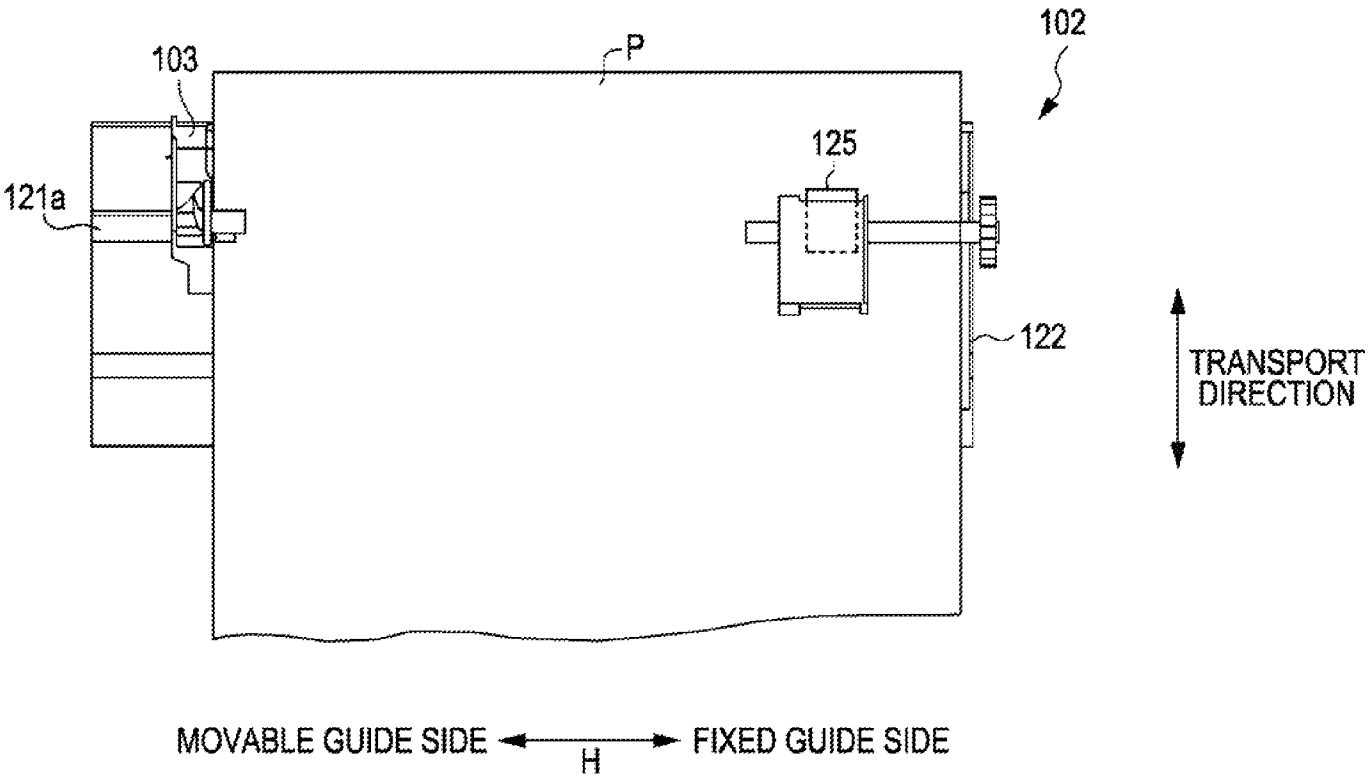
FIG. 20 (Prior Art)
FIG. 20 is a plan view of a paper supply apparatus for illustrating the state in which paper is transported when the paper is tilted relative to the transport direction.

In addition, the abutment roller 6 illustrated in FIG. 17 is, as shown in FIG. 18, provided in a position so as to abut the surface of the uppermost sheet of paper P when the maximum number of sheets of paper P that can be loaded has been placed upon the placement surface 32*a*. Accordingly, the paper P can be inserted between the placement surface 32*a* and the abutment roller 6 with ease, with the exception of the case where the maximum number of sheets of paper P has been loaded upon the placement surface 32*a*. FIG. 18 illustrates the manner in which the paper P is transported by the movable guide unit illustrated in FIG. 17, and the two-dot-dash line L in FIG. 18 indicates the transport path of the uppermost sheet of paper P in the case where the maximum number of sheets of paper P has been loaded upon the placement surface 32*a*.

Furthermore, as shown in FIGS. 14 and 18, the number of sheets of paper P that can be placed on the placement surface 32*a* is regulated by the protruding portion 33*b*. As a result, the maximum number of sheets of paper P that can be loaded upon the placement surface 32*a* is regulated by the protruding portion 33*b*. Accordingly, by making an interval M1 between the placement surface 32*a* and the abutment roller 6 uniform with an interval M2 between the placement surface 32*a* and the protruding portion 33*b*, the abutment roller 6 can be disposed in a position where the abutment roller 6 abuts the surface of the uppermost sheet of paper P in the case where the maximum number of sheets of paper P that can be loaded has been placed upon the placement surface 32*a*.

In the aforementioned variation, the protruding portion 33*b* that regulates the number of sheets of paper P that can be loaded upon the placement surface 32*a* also regulates the movement of the support member 4 toward the placement surface 32*a*, but a protruding portion that regulates the movement of the support member 4 toward the placement surface 32*a* may be provided separately from the protruding portion 33*b*.

In the aforementioned variation, the protruding portion 33*b* has a downstream side end 33*e* provided on the downstream side in the transport direction of the paper P, as shown in FIG. 17; it is preferable for the protruding portion 33*b* to be formed so that an interval M3 between the placement surface 32*a* and the downstream side end 33*e* increases toward the downstream side in the transport direction. According to such a configuration, the paper P can be prevented from being damaged by the protruding portion 33*b* when the paper P is transported downstream in the transport direction and in the direction away from the placement surface 32*a*.

In the aforementioned embodiment, the abutment roller 6 may be biased toward the placement surface 32*a* using a different elastic member, such as a compression spring, a plate spring, or the like.

The shape of the support member 4 may be altered as appropriate. Furthermore, the configuration may be such that the abutment roller 6 is provided in the movable guide 3, and the support member 4 is not used. In this case, the abutment roller 6 is supported by the movable guide 3 or an elastic member attached to the movable guide 3.

In the aforementioned embodiment, it is not absolutely necessary to rotate the abutment member, and a non-rotating resin molded article aside from a roller may be used as the abutment member instead.

What is claimed is:

1. A paper supply apparatus comprising:

a placement surface on which paper to be transported is placed;

a fixed guide that guides the transport of the paper by making contact with one side of the paper, in the widthwise direction;

a movable guide whose distance to the fixed guide in the widthwise direction of the paper is capable of being adjusted and that guides the transport of the paper by making contact with the other side of the paper, in the widthwise direction;

a paper supply roller that abuts a surface of the paper in a position, between the fixed guide and the movable guide, on the side where the fixed guide is located, and that is rotationally driven so as to transport the paper;

an abutment member, provided on the movable guide, that abuts the surface of the paper; and an elastic member that biases the abutment member toward the placement surface, wherein the abutment member is disposed in a position so that a second abutment point where the abutment member abuts the surface of the paper is further downstream in the transport direction of the paper than a first abutment point where the paper supply roller abuts the surface of the paper.

2. The paper supply apparatus according to claim 1, further comprising:

a support member that supports the abutment member in a freely-rotatable state on the movable guide, wherein the abutment member is biased toward the placement surface along with the support member.

3. The paper supply apparatus according to claim 2, wherein the abutment member is a roller supported in a rotatable state by the support member.

4. The paper supply apparatus according to claim 1, wherein the abutment member is disposed in a position that is at a predetermined interval from the placement surface.

5. The paper supply apparatus according to claim 4, wherein the abutment member is disposed in a position where the abutment member abuts the surface of the uppermost sheet of paper in the case where the maximum number of sheets of paper that is capable of being loaded has been placed upon the placement surface.

6. The paper supply apparatus according to claim 5, wherein the movable guide is provided with a protruding portion that protrudes toward the fixed guide, and the number of sheets of paper capable of being loaded upon the placement surface is regulated by the protruding portion.

7. The paper supply apparatus according to claim 6, wherein the protruding portion has a downstream side end portion provided on the downstream side of the protruding portion in the transport direction of the paper, and the protruding portion is formed so that an interval between the placement surface and the downstream side end portion increases progressively toward the downstream side in the transport direction.

8. The paper supply apparatus according to claim 1, wherein the elastic member is a torsion coil spring that is attached to the movable guide.

9. An image forming apparatus comprising:

an image forming unit that forms an image on paper; and a paper supply apparatus including:

a placement surface on which the paper is placed to be transported;

a fixed guide that guides the transport of the paper by making contact with one side of the paper, in the widthwise direction;

a movable guide whose distance to the fixed guide in the widthwise direction of the paper is capable of being adjusted and that guides the transport of the paper by making contact with the other side of the paper, in the widthwise direction;

a paper supply roller that abuts a surface of the paper in a position, between the fixed guide and the movable guide, on the side where the fixed guide is located, and that is rotationally driven so as to transport the paper;

an abutment member, provided on the movable guide, that abuts the surface of the paper; and an elastic member that biases the abutment member toward the placement surface, wherein the abutment member is disposed in a position so that a second abutment point where the abutment member abuts the surface of the paper is further downstream in the transport direction of the paper than a first abutment point where the paper supply roller abuts the surface of the paper.

10. The image forming apparatus according to claim 9, wherein the paper supply apparatus further includes a support member that supports the abutment member in a freely-rotatable state on the movable guide, and wherein the abutment member is biased toward the placement surface along with the support member.

11. The image forming apparatus according to claim 10, wherein the abutment member is a roller supported in a rotatable state by the support member.

12. The image forming apparatus according to claim 9, wherein the abutment member is disposed in a position that is at a predetermined interval from the placement surface.

13. The image forming apparatus according to claim 12, wherein the abutment member is disposed in a position where the abutment member abuts the surface of the uppermost sheet of paper in the case where the maximum number of sheets of paper that is capable of being loaded has been placed upon the placement surface.

14. The image forming apparatus according to claim 13, wherein the movable guide is provided with a protruding portion that protrudes toward the fixed guide, and the number of sheets of paper capable of being loaded upon the placement surface is regulated by the protruding portion.

15. The image forming apparatus according to claim 14, wherein the protruding portion has a downstream side end portion provided on the downstream side of the protruding portion in the transport direction of the paper, and the protruding portion is formed so that an interval between the placement surface and the downstream side end portion increases progressively toward the downstream side in the transport direction.

16. The image forming apparatus according to claim 9, wherein the elastic member is a torsion coil spring that is attached to the movable guide.

17. An image reading apparatus comprising:

an image reading unit that reads an image formed on paper; and a paper supply apparatus including:

a placement surface on which the paper is placed to be transported;

a fixed guide that guides the transport of the paper by making contact with one side of the paper, in the widthwise direction;

a movable guide whose distance to the fixed guide in the widthwise direction of the paper is capable of being adjusted and that guides the transport of the paper by making contact with the other side of the paper, in the widthwise direction;

a paper supply roller that abuts a surface of the paper in a position, between the fixed guide and the movable guide, on the side where the fixed guide is located, and that is rotationally driven so as to transport the paper;

an abutment member, provided on the movable guide, that abuts the surface of the paper; and an elastic member that biases the abutment member toward the placement surface, wherein the abutment member is disposed in a position so that a second abutment point where the abutment member abuts the surface of the paper is further downstream in the transport direction of the paper than a first abutment point where the paper supply roller abuts the surface of the paper.

18. The image reading apparatus according to claim 17, wherein the paper supply apparatus further includes a support member that supports the abutment member in a freely-rotatable state on the movable guide, and wherein the abutment member is biased toward the placement surface along with the support member.

19. The image reading apparatus according to claim 18, wherein the abutment member is a roller supported in a rotatable state by the support member.

20. The image reading apparatus according to claim 17, wherein the abutment member is disposed in a position that is at a predetermined interval from the placement surface.

21. The image reading apparatus according to claim 20, wherein the abutment member is disposed in a position where the abutment member abuts the surface of the uppermost sheet of paper in the case where the maximum number of sheets of paper that is capable of being loaded has been placed upon the placement surface.

22. The image reading apparatus according to claim 21, wherein the movable guide is provided with a protruding portion that protrudes toward the fixed guide, and the number of sheets of paper capable of being loaded upon the placement surface is regulated by the protruding portion.

23. The image reading apparatus according to claim 22, wherein the protruding portion has a downstream side end portion provided on the downstream side of the protruding portion in the transport direction of the paper, and the protruding portion is formed so that an interval between the placement surface and the downstream side end portion increases progressively toward the downstream side in the transport direction.

24. The image reading apparatus according to claim 17, wherein the elastic member is a torsion coil spring that is attached to the movable guide.

* * * * *